US008464795B2

(12) United States Patent
Dyson et al.

(10) Patent No.: US 8,464,795 B2
(45) Date of Patent: Jun. 18, 2013

(54) ANNULUS ISOLATION VALVE

(75) Inventors: Andy Dyson, Stonehaven (GB); Charles Li, Spring, TX (US); Oystein Mogedal, Oslo (NO); Paulo Cezar Silva Paulo, Katy, TX (US); Casey Russell, Cypress, TX (US); Nick Newlands, Oslo (NO)

(73) Assignee: Aker Solutions Inc., Houston, TX (US)

( * ) Notice: Subject to any disclaimer, the term of this patent is extended or adjusted under 35 U.S.C. 154(b) by 411 days.

(21) Appl. No.: 12/544,011

(22) Filed: Aug. 19, 2009

(65) Prior Publication Data

US 2010/0139910 A1 Jun. 10, 2010

Related U.S. Application Data

(60) Provisional application No. 61/090,462, filed on Aug. 20, 2008, provisional application No. 61/090,000, filed on Aug. 19, 2008.

(51) Int. Cl.
*E21B 34/02* (2006.01)

(52) U.S. Cl.
USPC ..... 166/334.1; 166/332.1; 166/386; 166/86.1; 137/496

(58) Field of Classification Search
USPC ..... 166/316, 332.1, 334.1, 373, 386, 166/368, 86.1, 95.1, 97.1, 75.13; 137/494, 137/496
See application file for complete search history.

(56) References Cited

U.S. PATENT DOCUMENTS

| | | | | |
|---|---|---|---|---|
| 4,869,318 | A | 9/1989 | Kellett | |
| 5,207,275 | A * | 5/1993 | Strattan et al. | 166/386 |
| 5,211,243 | A * | 5/1993 | Strattan et al. | 166/374 |
| 5,687,794 | A | 11/1997 | Watkins et al. | |
| 5,769,162 | A | 6/1998 | Bartlett et al. | |
| 5,778,918 | A | 7/1998 | McLelland | |
| 6,164,375 | A * | 12/2000 | Carisella | 166/65.1 |
| 6,729,392 | B2 | 5/2004 | DeBerry et al. | |
| 6,840,323 | B2 | 1/2005 | Fenton et al. | |
| 7,219,741 | B2 | 5/2007 | Fenton et al. | |
| 7,407,011 | B2 | 8/2008 | Kent | |
| 2006/0260799 | A1 | 11/2006 | Broussard | |

OTHER PUBLICATIONS

Search Report and Written Opinion from PCT/US2009/054341.

* cited by examiner

*Primary Examiner* — Shane Bomar
*Assistant Examiner* — Catherine Loikith
(74) *Attorney, Agent, or Firm* — Parsons Behle & Latimer

(57) ABSTRACT

An annulus isolation valve comprises a valve actuation bore and a flow passage capable of providing fluid communication between an upper annulus and a lower annulus. The flow passage comprises a first flow path and a portion of the valve actuation bore. Further, the first flow path has a second longitudinal axis that is different from a first longitudinal axis. The annulus isolation valve further includes a plug gate positioned in the valve actuation bore. The plug gate is configured so that in the open position it allows fluid communication between the upper annulus and the lower annulus. The annulus isolation valve further includes a biasing mechanism positioned in the valve actuation bore. The biasing mechanism is capable of forcing the plug gate into the closed position when the actuation force is not applied.

15 Claims, 4 Drawing Sheets

ANNULUS ISOLATION VALVE

The present disclosure claims benefit of U.S. Provisional Patent Application No. 61/090,462, filed Aug. 20, 2008, and U.S. Provisional Patent Application No. 61/090,000, filed Aug. 19, 2008, both of which applications are hereby incorporated by reference in their entirety.

BACKGROUND

1. Field of the Disclosure

The present disclosure relates generally to a wellhead apparatus, and in particular to an annulus isolation valve for use with a tubing hanger installed inside subsea wellhead.

2. Description of the Related Art

Tubing hangers are employed in subsea wellheads used in, for example, oil and gas wells. The tubing hanger supports the tubing, or "string", which extends down into the production zone of the well. The process of installing a tubing hanger into a wellhead generally involves positioning the tubing hanger on a landing seat in the wellhead using, for example, a running tool attached to the tubing hanger.

For a tubing hanger installed inside a wellhead, an annulus passage is generally used for monitoring pressure or communicating fluid to and from the annulus below the tubing hanger during installation of the tubing hanger (well completion) and throughout the life of a well. After well completion and before installation of the Christmas tree above the wellhead, all flow passages, including the annulus bore at the tubing hanger, must be sealed off to provide a temporary safety barrier so that the blowout preventer ("BOP") connected to the wellhead during completion can be removed.

Traditionally the temporary barriers of the production and annulus passages of the tubing hanger are wireline plugs to be removed after the Christmas tree has been installed. Alternatively, annulus isolation valves installed at the annulus bore of the tubing hanger can eliminate at least some of the operations associated with use of the wireline plugs, including, for example, setting and removing the wireline plugs. Additionally, employing annulus isolation valves can allow the use of a monobore riser for Christmas tree installation, because the passage for annulus wireline plug retrieval is no longer required.

The challenges for using annulus isolation valves inside tubing hangers include space limitation, reliability, decreased flow rate and particle size limits imposed by decreased size of flow passages through the valves, added cost and inconvenience of employing wireline tools to open and/or close the valves, and potential flow erosion of sealing surfaces. The present disclosure is directed to overcoming, or at least reducing the effects of, one or more of the issues set forth above.

SUMMARY

An embodiment of the present disclosure is directed to an annulus isolation valve. The annulus isolation valve comprises a valve actuation bore having a first longitudinal axis and a flow passage capable of providing fluid communication between an upper annulus and a lower annulus. The flow passage comprising a first flow path and a portion of the valve actuation bore. Further, the first flow path has a second longitudinal axis that is different from the first longitudinal axis. The annulus isolation valve further includes a plug gate positioned in the valve actuation bore. The plug gate is capable of moving between an open position and a closed position. The plug gate is configured so that in the open position it allows fluid communication between the upper annulus and the lower annulus. In the closed position, the plug gate is configured to block fluid communication between the upper annulus and the lower annulus. The annulus isolation valve further includes a biasing mechanism positioned in the valve actuation bore. The biasing mechanism is physically coupled to the plug gate so that an actuation force applied to the biasing mechanism is capable of moving the plug gate into the open position. The biasing mechanism further is capable of forcing the plug gate into the closed position when the actuation force is not applied.

Another embodiment of the present disclosure is directed to a wellhead assembly. The wellhead assembly comprises a tubing hanger positioned in the wellhead assembly, the tubing hanger comprising an annulus isolation valve. The wellhead assembly further comprises a tubing string extending downhole from the tubing hanger, the tubing string comprising a lower annulus. A production flow configuration extends uphole from the tubing hanger, the production flow configuration comprising an upper annulus. The annulus isolation valve comprises a valve actuation bore having a first longitudinal axis and a flow passage capable of providing fluid communication between an upper annulus and a lower annulus. The flow passage comprising a first flow path and a portion of the valve actuation bore. Further, the first flow path has a second longitudinal axis that is different from the first longitudinal axis. The annulus isolation valve further includes a plug gate positioned in the valve actuation bore. The plug gate is capable of moving between an open position and a closed position. The plug gate is configured so that in the open position it allows fluid communication between the upper annulus and the lower annulus. In the closed position, the plug gate is configured to block fluid communication between the upper annulus and the lower annulus. The annulus isolation valve further includes a biasing mechanism positioned in the valve actuation bore. The biasing mechanism is physically coupled to the plug gate so that an actuation force applied to the biasing mechanism is capable of moving the plug gate into the open position. The biasing mechanism further is capable of forcing the plug gate into the closed position when the actuation force is not applied.

Figure 1:
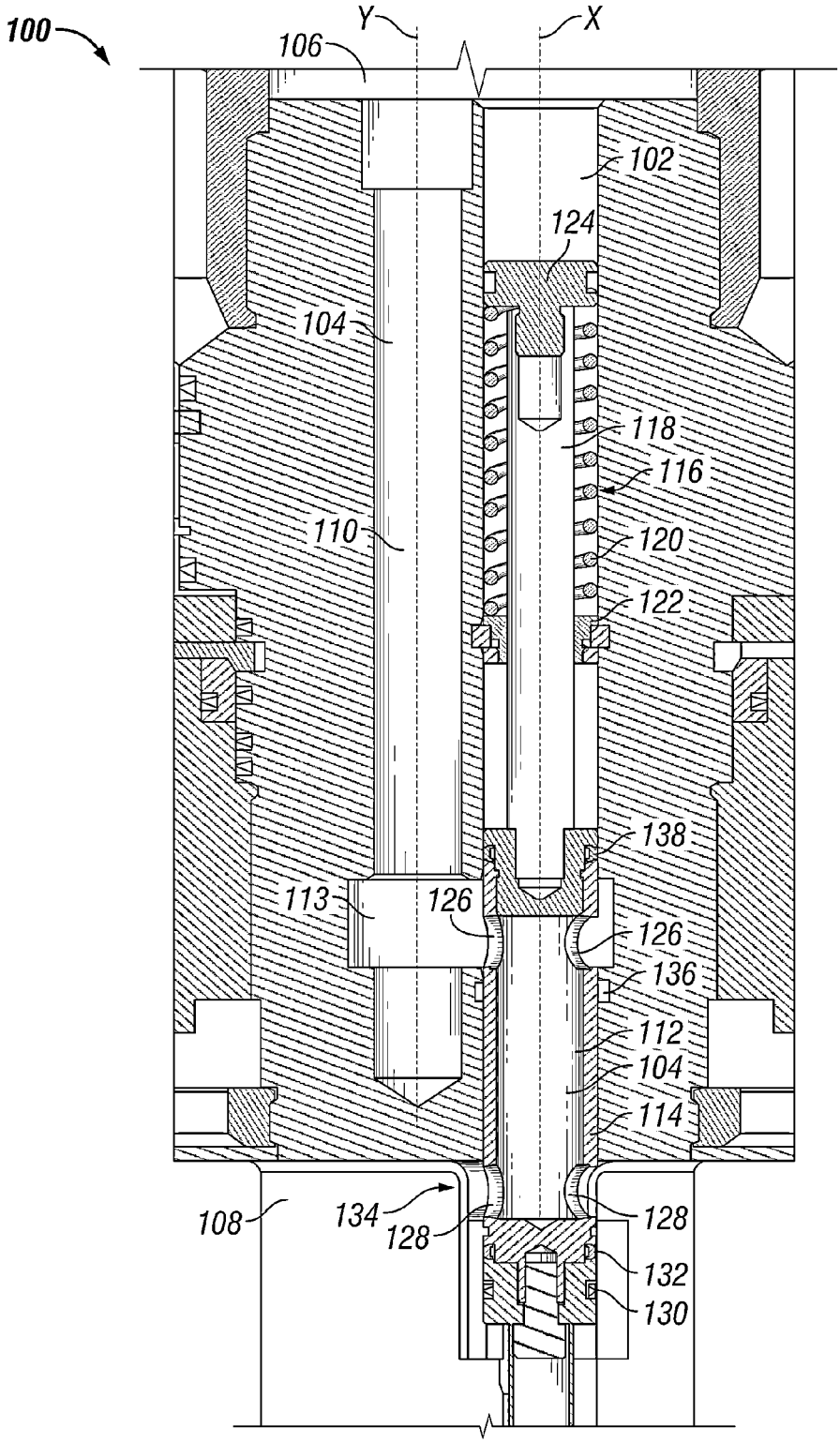
FIG. 1 illustrates a cross-sectional view of an annulus isolation valve in an open position, according to an embodiment of the present disclosure.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

DETAILED DESCRIPTION

The present disclosure is directed to an annulus isolation valve having a dual bore configuration. The annulus isolation valve of the present disclosure may exhibit one or more of the following advantages, including: increased flow rates, improved particle passage, improved reliability for valve closure, the ability to be operated by devices in a tree or in a running tool and the ability to allow secondary operations to both open and close.

FIG. 1 illustrates an annulus isolation valve 100, according to an embodiment of the present application Annulus isolation valve 100 comprises a valve actuation bore 102 having a first longitudinal axis, X. Annulus isolation valve 100 further comprises a flow passage 104, illustrated by flow arrows in FIG. 3, that can be capable of providing fluid communication between an upper annulus 106 and a lower annulus 108.

The flow passage 104 comprises a first flow path 110 and a portion of the valve actuation bore 102, which as illustrated in FIG. 1, comprises a plug gate 114 in an open position. In addition, the flow passage 104 can comprise a flow path connecting the first flow path 110 and the valve actuation bore 102, such as a transverse flow path 113. The first flow path 110 has a second longitudinal axis, Y, that is different from the X axis. In an embodiment, the X axis is parallel to the Y axis. The first flow path can be any suitable length.

Figure 3:
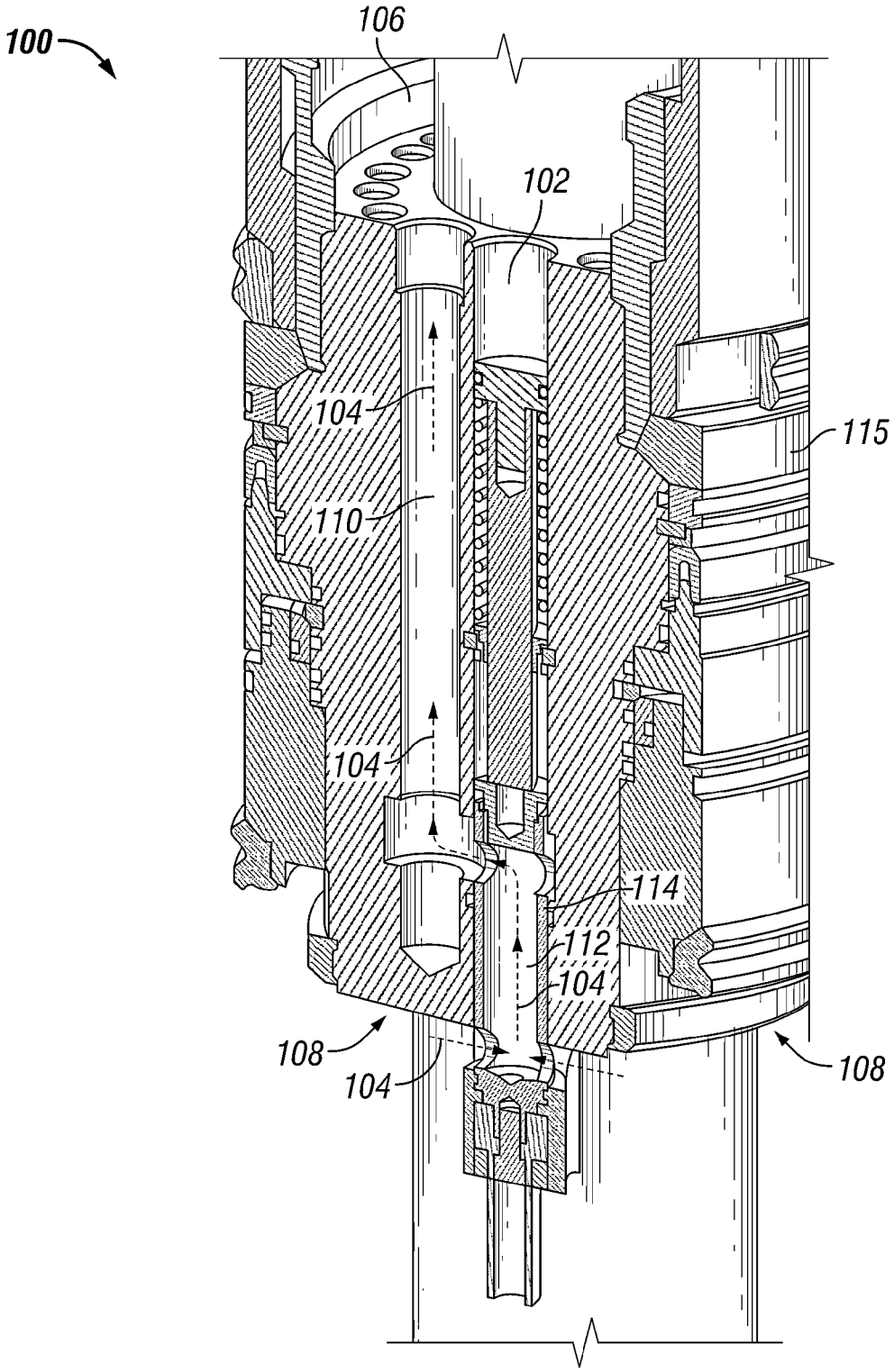
FIG. 3 illustrates a partial three dimensional cut-away view of an annulus isolation valve positioned in a tubing hanger, according to an embodiment of the present disclosure.

As shown in FIG. 3, the annulus isolation valve 100 comprising flow passage 104 can be positioned in a tubing hanger 115, according to an embodiment of the present disclosure. In other embodiments, the annulus isolation valve 100 can be positioned in any other suitable location within a wellbore.

A plug gate 114 can be positioned in the valve actuation bore 102. The plug gate 114 can be capable of moving between an open position, shown in FIG. 1, and a closed position, shown in FIG. 2. The plug gate 114 can be configured so that in the open position, plug gate 114 allows fluid communication between the upper annulus 106 and the lower annulus 108. In the closed position, plug gate 114 can be configured to block fluid communication between the upper annulus 106 and the lower annulus 108.

Referring to FIG. 1, plug gate 114 comprises one or more upper gate openings 126 and one or more lower gate openings 128 positioned below the upper gate openings 126, according to an embodiment of the present disclosure. The upper gate openings 126 of the plug gate 114 can fluidly connect with the transverse flow path 113 and the lower gate openings of the plug gate 114 fluidly connect with the lower annulus 108 when the plug gate is in the open position. A gate flow path 112 is positioned between the gate openings 126 and 128, so that fluid can flow through plug gate 114, thereby fluidly connecting upper annulus 106 and lower annulus 108 when plug gate 114 is in the open position.

An inlet 134 can provide fluid flow to the flow passage 104 of the annulus isolation valve 100. The inlet can be designed to be symmetrical in shape and oriented in a tangential direction to the flow through the lower annulus 108. It is thought that this orientation may help to reduce erosion of the inlet 134 by directing the opposing flows to meet, as illustrated by the flow arrows in FIG. 3, and thereby cancel out impingement before rising into flow path 104.

As illustrated in FIG. 1, a biasing mechanism 116 can be positioned in the valve actuation bore 102. By employing biasing mechanism 116, plug gate 114 is biased to the closed position. Biasing mechanism 116 can be physically coupled to the plug gate 114 so that an actuation force applied to the biasing mechanism 116 is capable of moving the plug gate 114 into the open position (shown in FIG. 1).

Figure 2:
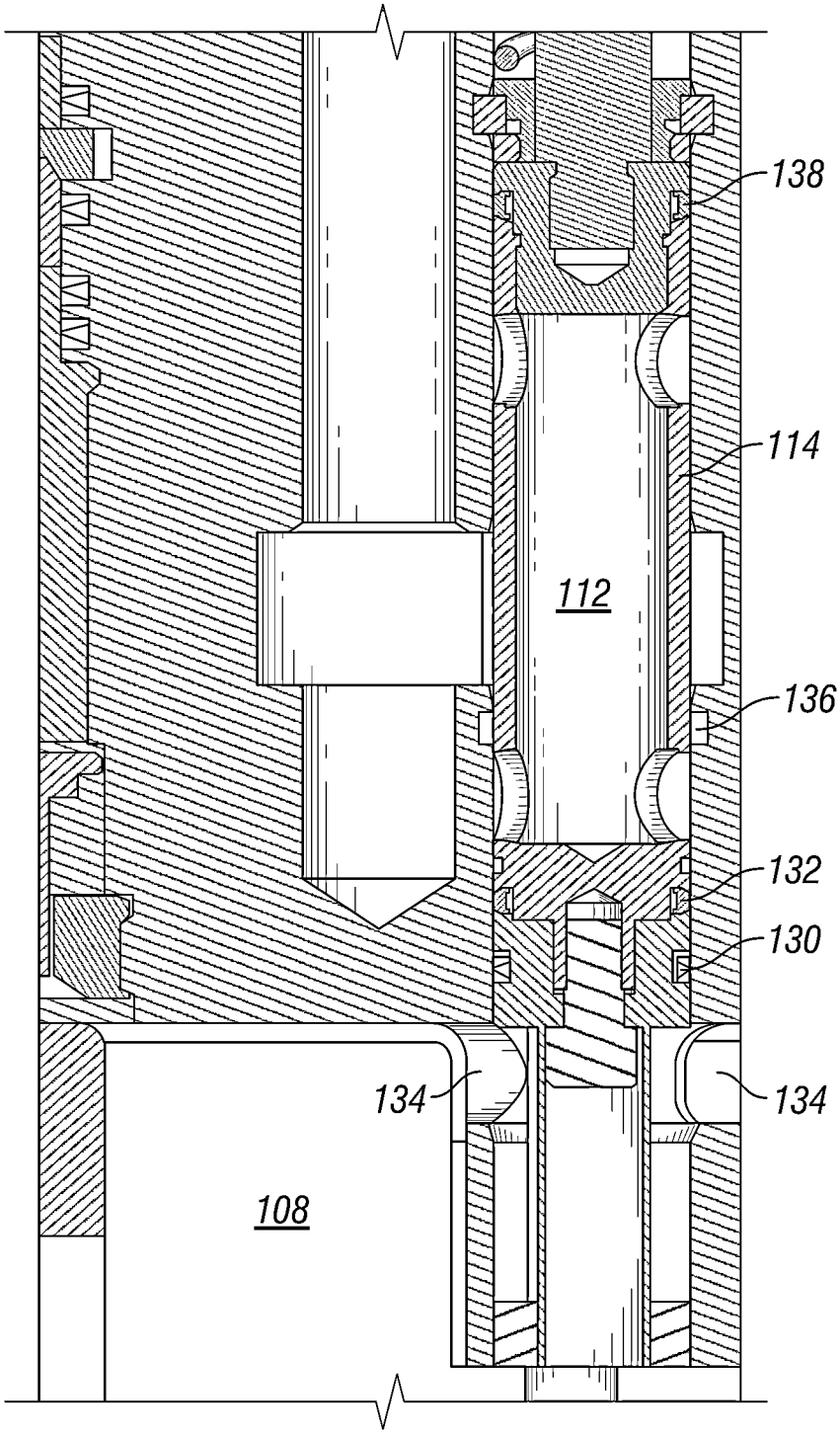
FIG. 2 illustrates a cross-sectional view of an annulus isolation valve in a closed position, according to an embodiment of the present disclosure.

Any suitable biasing mechanisms can be employed. An embodiment of the biasing mechanism can include a shaft 118 around which a spring 120 is positioned. The spring 120 can be positioned between a platform 122, which is fixed in position in the valve actuation bore 102, and a cap 124. A valve actuation mechanism (not shown) can be employed to force the plug gate 114 from the closed position, as shown in FIG. 2, to the open position of FIG. 1, thereby compressing spring 120. When the actuation force is no longer applied, the plug gate 114 can be forced back to the closed position by the biasing mechanism 116 as the spring 120 decompresses. In this manner the biasing mechanism 116 can act to close the annulus isolation valve 100 in case of equipment failure or other emergency conditions that may occur in the wellbore.

A secondary method for closing the annulus isolation valve will now be described. In this method, a sealing stab (not shown) can be installed at the top of the annulus flow bore 104 to isolate the upper annulus 106 from the lower annulus 108. In this manner, a higher pressure from below the hanger can be introduced that results in a sufficient force at the middle seal 138 to push the plug gate 114 upward. The presence of the lower annulus pressure can keep the plug gate 114 in the closed position. Similarly, pressure from the upper annulus 106 can be employed to move the plug gate 114 downward from closed to open, which can provide a secondary opening mechanism.

In an embodiment, cap 124 can act directly as an interface for the actuator mechanism. In an alternative embodiment, the actuator interface may include components, in addition to cap 124, so that the cap 124 does not directly contact the actuator mechanism.

Other suitable biasing mechanisms can also be employed, such as, for example, a mechanism that applies a biasing force to the plug gate 114 via hydraulic pressure. One of ordinary skill in the art would be capable of making and using such a biasing mechanism given the teachings of the present disclosure.

Any suitable actuation mechanism can be employed to open the annulus isolation valve 100. In an embodiment, the actuation mechanism can be external of the tubing hanger. Examples of suitable actuation mechanisms can include a rod or hollow sleeve designed to apply the appropriate force to the biasing mechanism 116, or a hydraulic means for applying actuation force.

One or more seals can be employed in the annulus isolation valve 100. The seals can be positioned in any suitable manner. In an embodiment, the seals can be positioned to provide the desired sealing of the valve actuation bore 102 and to protect the seals themselves from damage, due to, for example exposure to high flow rates and/or high fluid pressures. This can allow the valve to be opened under pressure from the lower annulus 108 while preventing or reducing damage to the seals.

In an embodiment, the seals can be positioned to protect the sealed areas, including the spring 120, from leakage and debris. For example, as illustrated in FIG. 2, a debris seal 136 can be positioned in the valve actuation bore. A middle seal 138 can also be positioned in the plug gate 114.

Additionally, plug gate 114 can comprise a resilient seal 130 and a blowout resistant seal 132. The seals 130 and 132 can be positioned so that as the plug gate 114 is forced down through the valve actuation bore 102, the resilient seal 130 is exposed to the lower annulus 108 before the blowout resistant seal 132, which continues to seal the valve actuation bore 102. The blowout resistant seal 132 is positioned so that as the plug gate 114 continues to be forced down through the valve actuation bore 102, the blow out resistant seal 132 can be positioned in openings 134 and exposed to the lower annulus 108 while the plug gate 114 constrains fluid flow from the lower annulus 108 into the gate flow path 112. By constraining the flow until the blow out resistant seal 132 moves to a safe distance from the high velocity flow field, damage to the blow out resistant seal 132 can be reduced. The movement of the blowout resistant seal 132 as it exits the valve actuation bore 102 may be opposite to the fluid pressure, which may tend to force the plug gate 114 in the up-hole direction.

Figure 4:
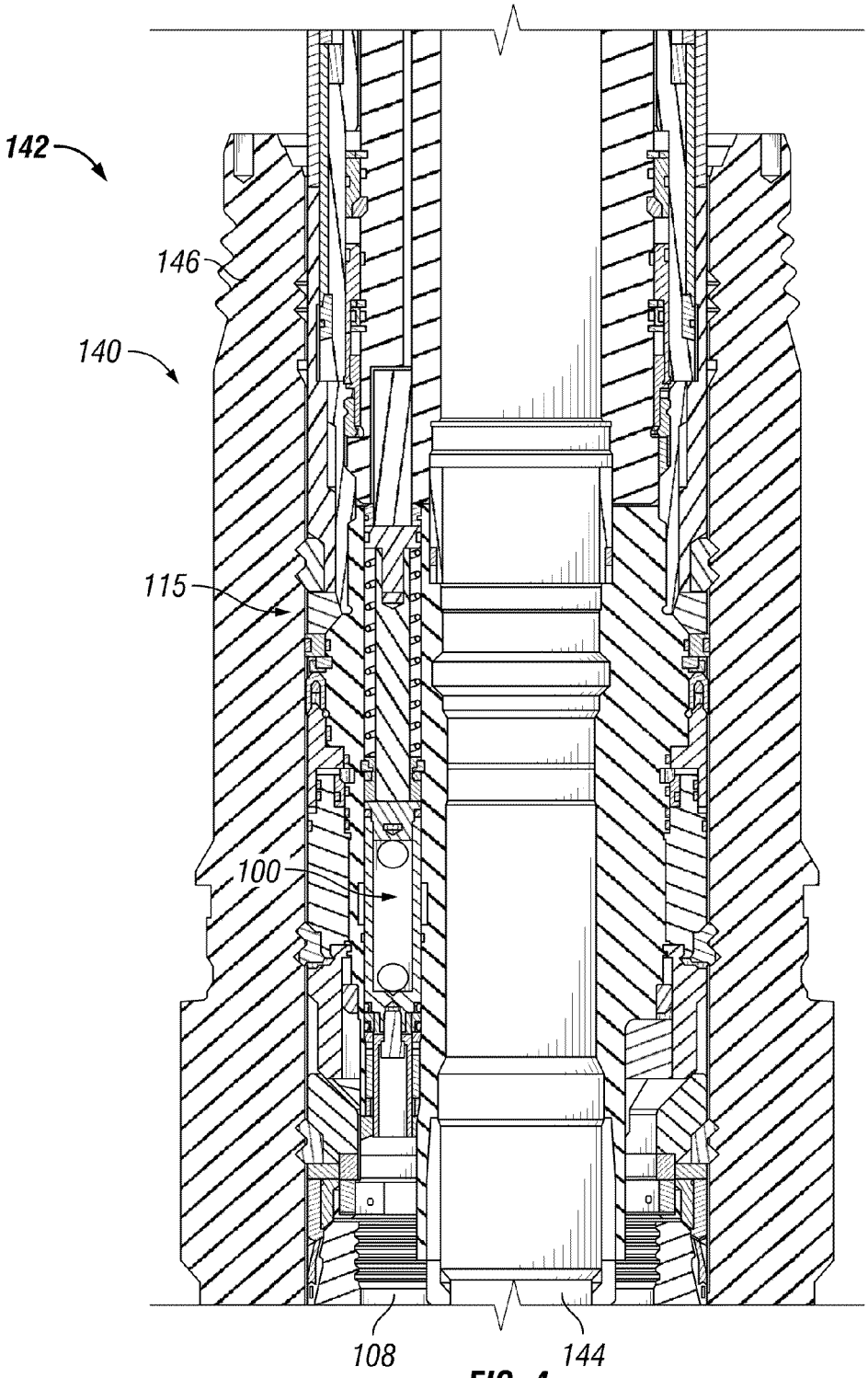
FIG. 4 illustrates a wellhead assembly of a hydrocarbon production well comprising an annulus isolation valve, according to an embodiment of the present disclosure.

In an embodiment of the present disclosure, the annulus isolation valves can be employed in any type of subsea well, including, for example, hydrocarbon production wells, such as oil and natural gas wells. FIG. 4 illustrates a wellhead assembly 140 of a hydrocarbon production well 142. Wellhead assembly 140 comprises a wellhead spool 146 and tubing hanger 115. The annulus isolation valves of the present application can also be employed in various other applications, such as, for example, as a manifold injection valve or as a valve in a high pressure debris cap.

Tubing hanger 115 is positioned in the wellhead assembly 140. The tubing hanger 115 comprising an annulus isolation valve 100 of the present application. In an embodiment, the tubing hanger 115 can comprise a plurality of annulus isolation valves 100. A tubing string 144 extends down-hole from the tubing hanger 115. The production casing (not shown) and the tubing string 144 below the tubing hanger 115 form lower annulus 108. A production flow configuration, which can include, for example, a subsea tree (not shown), can extend up-hole from the tubing hanger 115. The production flow configuration can comprise an upper annulus 106, as shown in FIG. 3.

Although various embodiments have been shown and described, the disclosure is not so limited and will be understood to include all such modifications and variations as would be apparent to one skilled in the art.

What is claimed is:

1. An annulus isolation valve, comprising:

a valve actuation bore having a first longitudinal axis;

a flow passage capable of providing fluid communication between an upper annulus and a lower annulus, the flow passage comprising a first flow path and a portion of the valve actuation bore, the first flow path having a second longitudinal axis that is different from the first longitudinal axis;

a plug gate positioned in the valve actuation bore having a first opening, a second opening positioned below the first opening, and a gate flow path between the first and second openings that is a portion of the flow passage, the plug gate capable of moving between an open position and a closed position, the plug gate in the open position being configured to allow fluid communication between the upper annulus and the lower annulus, and the plug gate in the closed position being configured to block fluid communication between the upper annulus and the lower annulus;

a biasing mechanism positioned in the valve actuation bore, the biasing mechanism being physically coupled to the plug gate so that an actuation force applied to the biasing mechanism is capable of moving the plug gate into the open position, the biasing mechanism further being capable of forcing the plug gate into the closed position when the actuation force is not applied; and wherein a transverse flow path fluidly connects the first flow path and the valve actuation bore, the first opening of the plug gate fluidly connects with the transverse flow path, and the second opening of the plug gate is adjacent to and fluidly connects with the lower annulus when the plug gate is in the open position.

2. The valve of claim 1, wherein the first longitudinal axis is parallel to the second longitudinal axis.

3. The valve of claim 1, wherein the flow passage is positioned in a tubing hanger.

4. The valve of claim 1, wherein the plug gate comprises a resilient seal and a blowout resistant seal, the resilient seal and the blowout resistant seal being positioned so that as the plug gate is forced down through the valve actuation bore, the resilient seal is exposed to the lower annulus before the blowout resistant seal.

5. The valve of claim 4, wherein the blowout resistant seal is positioned so that as the plug gate is forced down through the valve actuation bore, the resilient seal is first exposed to the lower annulus while the blow out resistant seal constrains fluid flow from the lower annulus into the plug gate.

6. The annulus isolation valve of claim 1, wherein the biasing mechanism comprises a shaft coupled to the plug gate and a spring positioned around the shaft.

7. A wellhead assembly comprising:

a tubing hanger positioned in the wellhead assembly, the tubing hanger comprising an annulus isolation valve;

a tubing string extending down-hole from the tubing hanger, the tubing string comprising a lower annulus;

a production flow configuration extending up-hole from the tubing hanger, the production flow configuration comprising an upper annulus;

wherein the annulus isolation valve comprises:

a valve actuation bore having a first longitudinal axis;

a flow passage providing fluid communication between the upper annulus and the lower annulus, the flow passage comprising a first flow path and a portion of the valve actuation bore, the first flow path having a second longitudinal axis that is different from the first longitudinal axis;

a plug gate positioned in the valve actuation bore having a first opening, a second opening positioned below the first opening, and a gate flow path between the first and second openings that is a portion of the flow passage, the plug gate capable of moving between an open position and a closed position, the plug gate in the open position being configured to allow fluid communication between the upper annulus and the lower annulus, and the plug gate in the closed position being configured to block fluid communication between the upper annulus and the lower annulus;

a biasing mechanism positioned in the valve actuation bore, the biasing mechanism being physically coupled to the plug gate so that an actuation force applied to the biasing mechanism is capable of moving the plug gate into the open position, the biasing mechanism further being capable of forcing the plug gate into the closed position when the actuation force is not applied; and wherein a transverse flow path fluidly connects the first flow path and the valve actuation bore, the first opening of the plug gate fluidly connects with the transverse flow path, and the second opening of the plug gate is adjacent to and fluidly connects with the lower annulus when the plug gate is in the open position.

8. The wellhead assembly of claim 7, wherein the tubing hanger comprises a plurality of annulus isolation valves.

9. The wellhead assembly of claim 7, wherein the first longitudinal axis is parallel to the second longitudinal axis.

10. The wellhead assembly of claim 7, wherein the plug gate comprises a resilient seal and a blowout resistant seal, the resilient seal and the blowout resistant seal being positioned so that as the plug gate is forced down through the valve actuation bore, the resilient seal is exposed to the lower annulus before the blowout resistant seal.

11. The wellhead assembly of claim 10, wherein the blowout resistant seal is positioned so that as the plug gate is forced down through the valve actuation bore, the resilient seal is first exposed to the lower annulus while the blow out resistant seal constrains fluid flow from the lower annulus into the plug gate.

12. The wellhead assembly of claim 7, wherein the biasing mechanism comprises a shaft coupled to the plug gate and a spring positioned around the shaft.

13. An annulus isolation valve comprising:

a valve actuation bore having a first longitudinal axis;

a first flow path having a second longitudinal axis different from the first longitudinal axis, the first flow path in fluid communication with an upper annulus;

a plug gate positioned in the valve actuation bore having a first opening, a second opening positioned below the first opening, and a second flow path between the first and second openings; and a mechanism positioned in the valve actuation bore configured to move the plug gate between a closed position and an open position, the mechanism being biased to move the plug gate to the closed position, wherein the plug gate in the open position permits fluid to flow from a lower annulus directly through the second opening into the second flow path and out the first opening into the first flow path to the upper annulus and the plug gate in the closed position being configured to block fluid communication between the upper annulus and the lower annulus.

14. The annulus isolation valve of claim 13 further comprising a blowout resistant seal on the plug gate below the second opening and a resilient seal on the plug gate below the blowout resistant seal so that the resilient seal is exposed to the lower annulus first as the plug gate moves from the closed position to the open position.

15. The annulus isolation valve of claim 13, wherein the first flow path is in communication with the upper annulus when the plug gate is in the closed position.

* * * * *